US009091401B2

(12) United States Patent
Wong et al.

(10) Patent No.: US 9,091,401 B2
(45) Date of Patent: Jul. 28, 2015

(54) WORK LIGHT

(71) Applicant: Milwaukee Electric Tool Corporation, Brookfield, WI (US)

(72) Inventors: Ngai Pang Wong, Hong Kong (CN); Jonathan A. Zick, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 58 days.

(21) Appl. No.: 14/086,187

(22) Filed: Nov. 21, 2013

(65) Prior Publication Data

US 2014/0140050 A1 May 22, 2014

Related U.S. Application Data

(60) Provisional application No. 61/729,068, filed on Nov. 21, 2012, provisional application No. 61/755,145, filed on Jan. 22, 2013.

(51) Int. Cl.

| | |
|---|---|
| ***F21V 21/30*** | (2006.01) |
| ***F21L 4/02*** | (2006.01) |
| ***F21V 14/02*** | (2006.01) |
| ***F21V 21/06*** | (2006.01) |
| *F21V 21/40* | (2006.01) |

(Continued)

(52) U.S. Cl.

CPC ..... *F21L 4/02* (2013.01); *F21V 14/025* (2013.01); *F21V 21/06* (2013.01); *F21V 21/406* (2013.01); *F21V 23/0414* (2013.01); *F21Y 2101/02* (2013.01); *F21Y 2103/003* (2013.01)

(58) Field of Classification Search

CPC ..... F21L 4/027; F21L 4/04; F21L 14/02; F21L 14/025; F21L 13/06; F21L 11/00; F21V 21/0832; F21V 21/14; F21V 21/30; F21S 8/031; F21S 2/00; F21S 4/00; F21S 4/003; F21S 10/02; F21S 4/008; F21S 4/10; F21S 6/002; F21S 6/003; B60Q 1/245; B60Q 3/001; B60Q 3/00; B60Q 1/02; F21K 9/135; F21K 9/137; F21K 9/58

USPC ..... 362/197, 200, 232, 249.01, 249.02, 362/249.03, 249.07, 269, 272, 276, 362/285–287, 372, 500, 577, 800, 802, 806, 362/219, 220, 223, 238, 239, 464, 512, 520, 362/523, 540, 543–546, 549

See application file for complete search history.

(56) References Cited

U.S. PATENT DOCUMENTS 4,483,683 A * 11/1984 Alley, Sr. ..... 441/69
5,688,042 A * 11/1997 Madadi et al. ..... 362/240

(Continued)

OTHER PUBLICATIONS

Fox Fury Lighting Solutions, "Nomad 360 Portable Scene Light" <http://www.foxfury.com/catalog/product_info.php?products_id=194> webpage available as early as Jul. 28, 2012.

*Primary Examiner* — Hargobind S Sawhney

(74) *Attorney, Agent, or Firm* — Michael Best & Friedrich LLP

(57) ABSTRACT

The invention provides, in one aspect, a work light including a housing and a plurality of light sources coupled to the housing. At least one of the light sources is movable relative to the housing to vary a lighting pattern emitted by the light sources relative to an outer periphery of the housing. The work light also includes an actuator coupled to the at least one movable light source for moving the light source relative to the housing.

9 Claims, 6 Drawing Sheets

(51) Int. Cl.

| | |
|---|---|
| *F21V 23/04* | (2006.01) |
| *F21Y 101/02* | (2006.01) |
| *F21Y 103/00* | (2006.01) |

(56) References Cited

U.S. PATENT DOCUMENTS

| | | | | |
|---|---|---|---|---|
| 6,877,876 | B1 * | 4/2005 | Steinhilber | 362/188 |
| 7,311,423 | B2 * | 12/2007 | Frecska et al. | 362/372 |
| 7,699,491 | B2 * | 4/2010 | Sharrah et al. | 362/191 |
| 7,717,586 | B2 * | 5/2010 | Tucker | 362/249.05 |
| 7,891,841 | B2 * | 2/2011 | Levine | 362/249.07 |
| 7,967,466 | B2 * | 6/2011 | Chu | 362/183 |
| 8,029,159 | B2 * | 10/2011 | Chen | 362/249.1 |
| 8,075,163 | B2 * | 12/2011 | Xiao et al. | 362/287 |
| 8,096,684 | B2 * | 1/2012 | Salm et al. | 362/272 |
| 8,201,974 | B1 * | 6/2012 | Smith et al. | 362/257 |
| 8,337,059 | B2 * | 12/2012 | Barnett et al. | 362/470 |
| 8,485,683 | B2 * | 7/2013 | Popper et al. | 362/188 |
| 8,511,847 | B2 * | 8/2013 | Sharrah et al. | 362/199 |
| 8,641,241 | B2 * | 2/2014 | Farmer | 362/368 |
| 8,674,266 | B2 * | 3/2014 | Fis-Menache | 219/209 |
| 8,791,640 | B2 * | 7/2014 | Steele et al. | 315/185 R |
| 2012/0057333 | A1 * | 3/2012 | Bhardwaj et al. | 362/183 |
| 2012/0079755 | A1 * | 4/2012 | Torres et al. | 43/17.5 |
| 2014/0204218 | A1 * | 7/2014 | Gebhard et al. | 348/164 |

* cited by examiner

WORK LIGHT

CROSS REFERENCE TO RELATED APPLICATIONS

This application claims priority to U.S. Provisional Patent Application No. 61/755,145 filed on Jan. 22, 2013, and U.S. Provisional Patent Application No. 61/729,068 filed on Nov. 21, 2012, the entire contents of both of which are incorporated herein by reference.

FIELD OF THE INVENTION

The invention relates to work lights, and more particularly to cordless work lights.

BACKGROUND OF THE INVENTION

Work lights are often used for illuminating a workspace. Such work lights are typically configured to emit light around their entire periphery or in a single (e.g., forward) direction for illuminating the workspace in front of an individual.

SUMMARY OF THE INVENTION

The invention provides, in one aspect, a work light including a housing and a plurality of light sources coupled to the housing. At least one of the light sources is movable relative to the housing to vary a lighting pattern emitted by the light sources relative to an outer periphery of the housing. The work light also includes an actuator coupled to the at least one movable light source for moving the light source relative to the housing.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
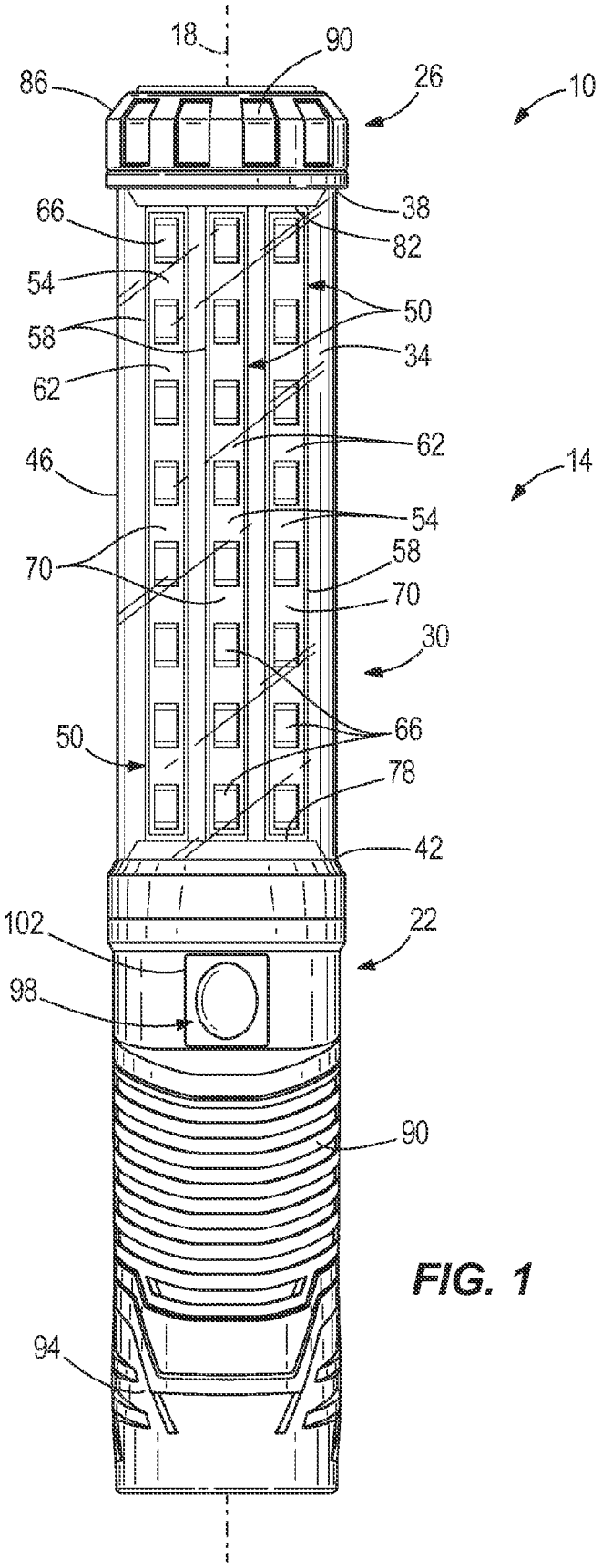
FIG. 1 is a front view of a work light according to an embodiment of the invention.
Figure 2:
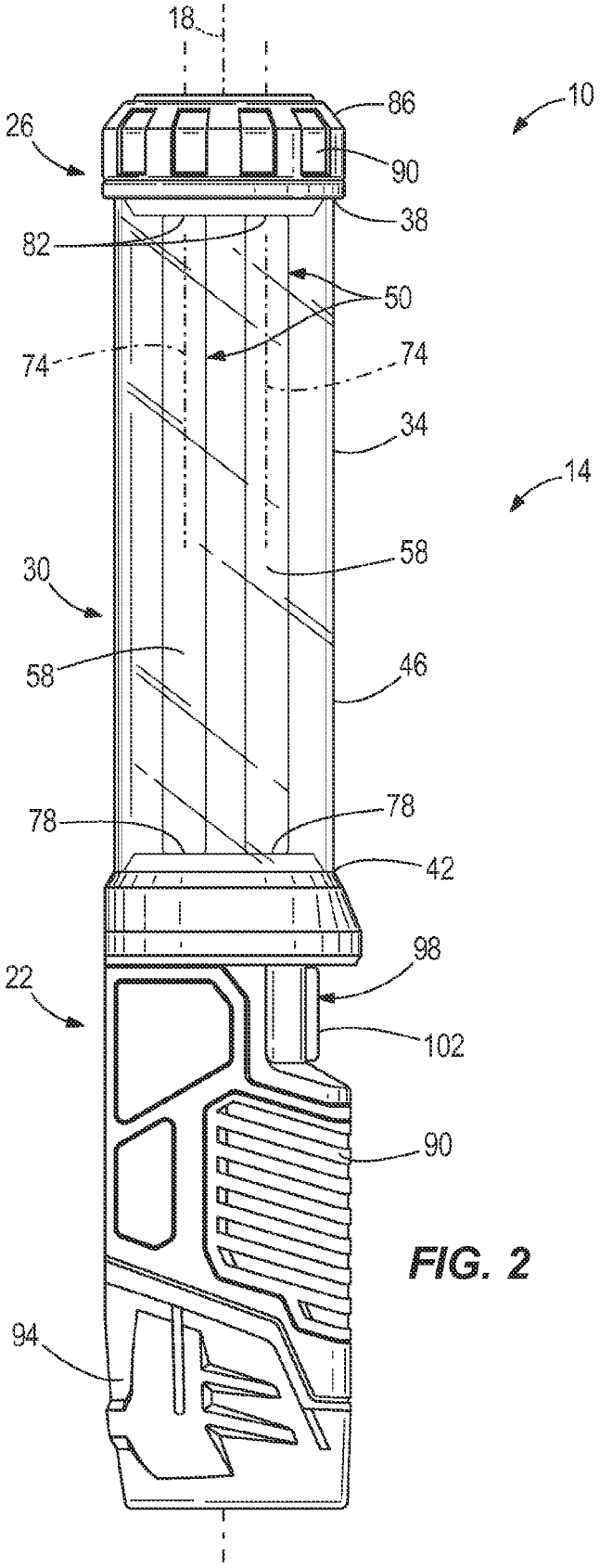
FIG. 2 is a side view of the work light of FIG. 1.

FIGS. 1 and 2 illustrate a work light 10 for providing illumination to a workspace. The work light 10 includes a substantially cylindrical housing 14 defining a central axis 18 (FIG. 1). More particularly, the housing 14 includes a base portion 22, a cap portion 26, and a translucent portion 30 disposed between the base portion 22 and the cap portion 26. In the illustrated embodiment of the work light 10, the translucent portion 30 is a separate tubular member 34 having a first end 38, a second end 42, and an outer periphery 46, with the first end 38 being positioned adjacent the cap portion 26 and the second end 42 being positioned adjacent the base portion 22. The cap portion 26, the tubular member 34, and the base portion 22 may be interconnected in any of a number of different ways to maintain the cap portion 26, the tubular member 34, and the base portion 22 as an inseparable unit. Alternatively, the translucent portion 30 may be integrally formed as a single piece with either of the cap portion 26 or the base portion 22. As a further alternative, the cap portion 26, the translucent portion 30, and the base portion 22 may be integrally formed as a single piece. The translucent portion 30 is made of a clear, plastic material, but may be made of an alternative translucent material (e.g., glass, etc.).

With continued reference to FIGS. 1 and 2, the work light 10 also includes a plurality of light sources 50 positioned in the translucent portion 30 of the housing 14. As shown in FIGS. 1 and 2, three light sources 50 are visible through the translucent portion 30 of the housing 14 a full 360 degrees around the outer periphery 46 of the housing 14. In the illustrated embodiment of the work light 10, each of the three light sources 50 includes an elongated light-emitting diode (LED) strip 54 and a substantially rigid, tubular member 58 in which the LED strip 54 is contained. Each of the LED strips 54 may be supported within and/or affixed to its corresponding tubular member 58 in any of a number of different ways such that the LED strip 54 is prevented from moving relative to the tubular member 58. Each of the LED strips 54 includes a flat, thin substrate 62 and a plurality of LEDs 66 positioned on a front surface 70 of the substrate 62. The LEDs 66 are spaced equally along the length of the substrate 62. Alternatively, the light sources 50 may include different forms of lights (e.g., incandescent, fluorescent, etc.).

The light sources 50 are rotatably coupled to the housing 14 to vary a lighting pattern emitted by the light sources 50 relative to the outer periphery 46 of the housing 14. In the illustrated embodiment of the work light 10, each of the light sources 50 is rotatable about an axis 74 (FIG. 2) substantially parallel to the central axis 18. In the illustrated embodiment, the light sources 50 are positioned in a triangular arrangement such that only two light sources 50 are visible from the side view (FIG. 2), while all three light sources 50 are visible from the front view (FIG. 1). All of the light sources 50 are illustrated in FIGS. 1 and 2 in a forward facing orientation. More particularly, a lower end 78 of each of the light sources 50 is rotatably supported within the base portion 22, while an upper end 82 of each of the light sources 50 is interconnected to the cap portion 26. In the illustrated embodiment of FIGS. 1 and 2, the cap portion 26 is operable as an actuator 86 for rotating the light sources 50 about their respective axes 74. Further, a transmission (e.g., a gear train or other arrangement, not shown) is disposed between the cap portion 26 and the light sources 50 such that rotation of the cap portion 26 causes individual and simultaneous rotation of the light sources 50 relative to the translucent portion 30 of the housing 14. The cap portion 26 and the base portion 22 each include an exterior overmold grip 90 that a user can grasp for rotating the cap portion 26. In an alternative embodiment of the work light 10, fewer than all of the light sources 50 may be rotatably coupled to the housing 14 to vary the overall lighting pattern emitted by the light sources 50. In other words, some of the light sources 50 may be stationary or affixed within the housing 14.

With continued reference to FIGS. 1 and 2, the work light 10 includes a power tool battery pack 94 removably coupled to the base portion 22 to provide electrical energy to the light sources 50. Particularly, the base portion 22 includes a cavity (not shown) in which the battery pack 94 is removably received. Such a battery pack 94 may be configured as a rechargeable power tool battery pack that is usable with a variety of power tools (e.g., drills, screwdrivers, saws, or the like). The battery pack 94 may be a twelve-volt (12V) battery pack. The battery pack 94 may also include three battery cells having, for example, a lithium (Li), lithium-ion (Li-ion), or other lithium-based chemistry. For example, the battery cells may have a chemistry of lithium-cobalt (Li—Co), lithium-manganese (Li—Mn) spinel, or Li—Mn nickel. In such embodiments, each battery cell may have a nominal voltage of about, for example, 3.6V, 4.0V, or 4.2V. In other embodiments, the battery cells may have a nickel-cadmium, nickel-metal hydride, or lead acid battery chemistry. In further embodiments, the battery pack 94 may include fewer or more battery cells, and/or each battery cell may have a different nominal voltage. The battery pack 94 allows cordless operation and provides ease of transport of the work light 10.

The work light 10 further includes a switch 98 located on the base portion 22 for selectively electrically connecting the battery pack 94 to the light sources 50. In the illustrated embodiment of the work light 10, the switch 98 includes a push-button actuator 102 that may be depressed a first time to illuminate the light sources 50, and a second time to turn off the light sources 50. Alternatively, the switch 98 may include any of a number of different actuators (e.g., a sliding actuator, a toggle, etc.).

Figure 3:
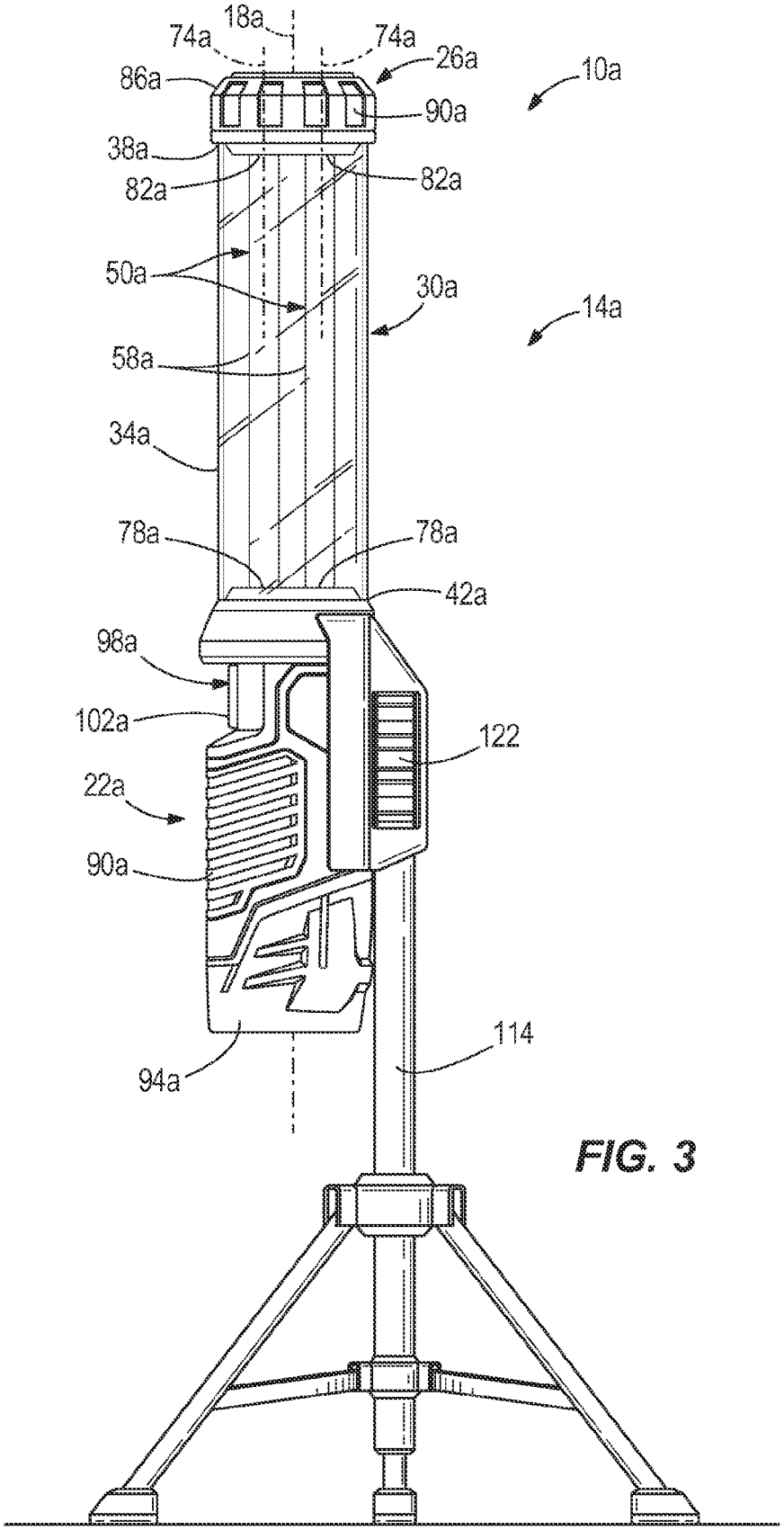
FIG. 3 is a side view of a work light according to another embodiment of the invention, shown mounted to a stand.
Figure 4:
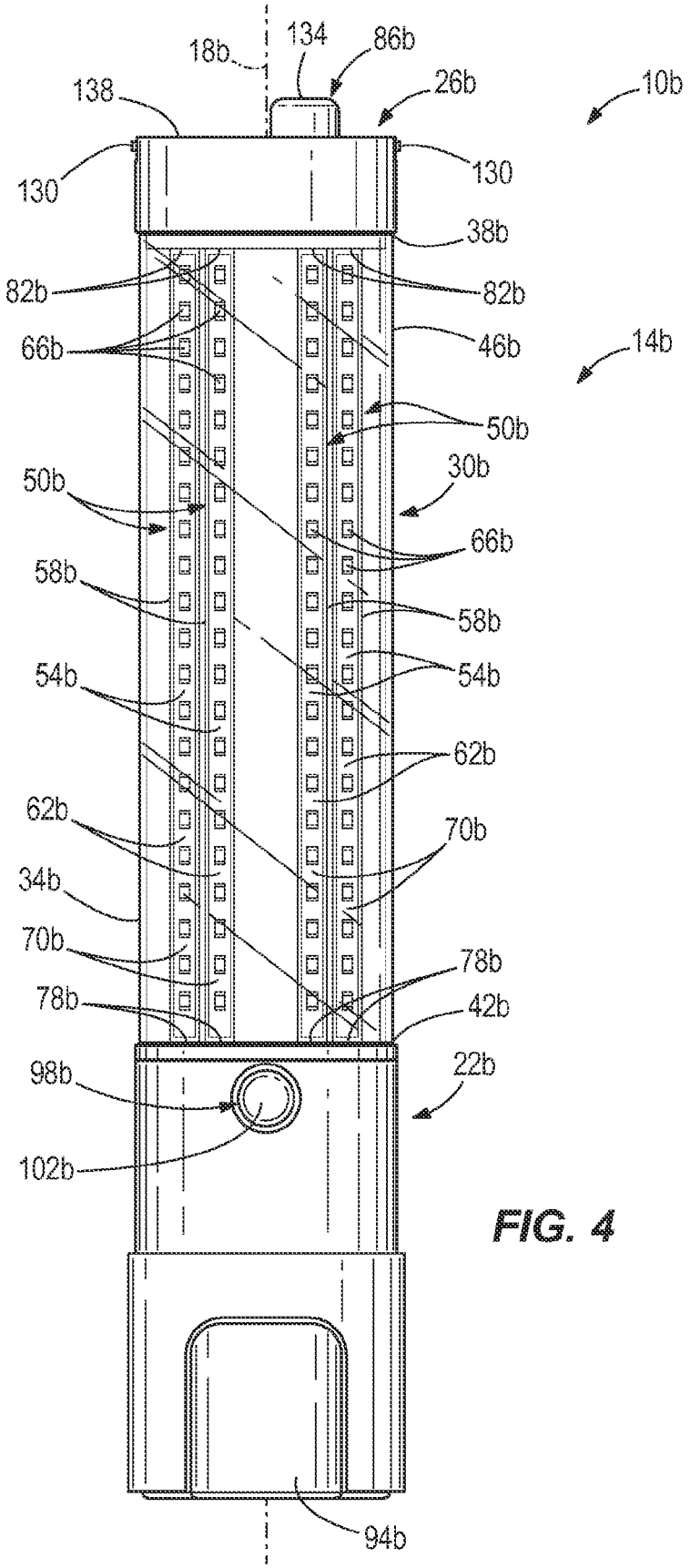
FIG. 4 is a front view of a work light according to yet another embodiment of the invention.
Figure 5:
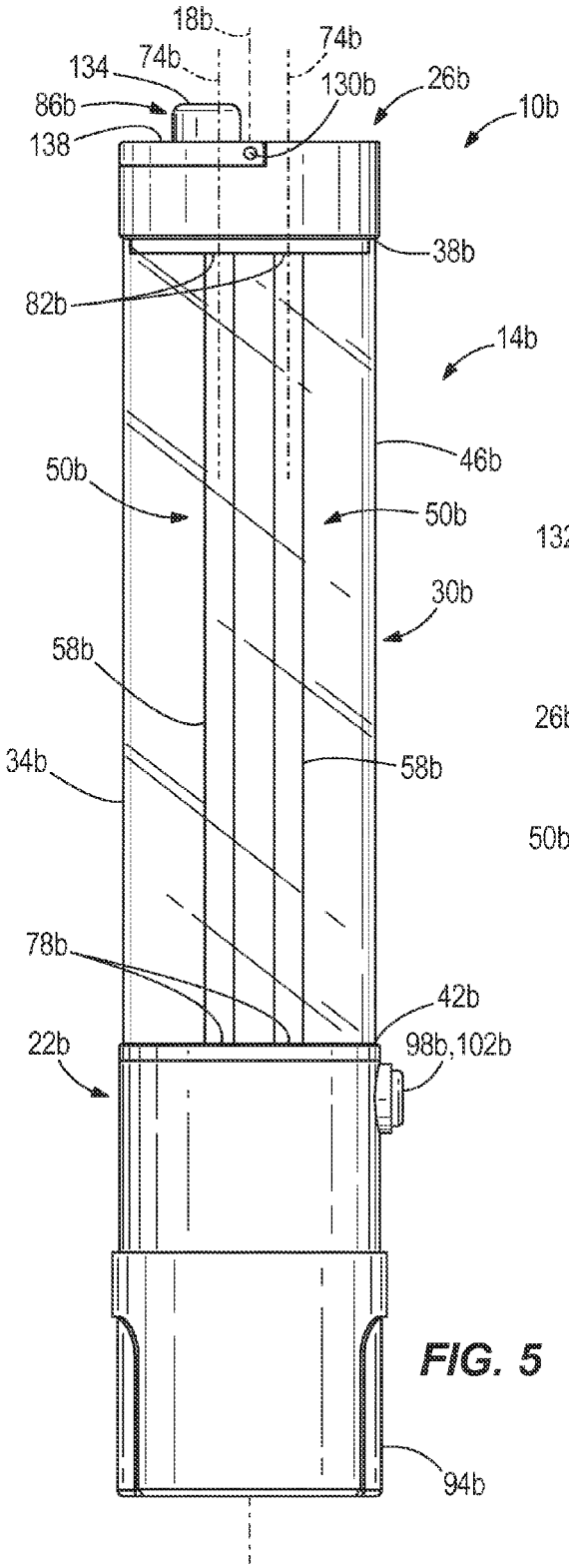
FIG. 5 is a side view of the work light of FIG. 4.

Another embodiment of the work light 10*a* is shown in FIG. 3, with like components and features of the work light 10 of FIGS. 1 and 2 being identified with like reference numerals with the letter "a." The base portion 22*a* includes a receptacle in which a tube of a stand 114 may be received. The work light 10*a* also includes a fastener (e.g., a set screw, not shown) at least partially disposed within the receptacle for clamping the work light 10*a* to the stand 114. The set screw is co-rotatable with a knob 122 which, in turn, is rotatably supported within the base portion 22*a* of the housing 14*a*. The illustrated stand 114 is configured as a tripod; however, the work light 10*a* may be used with any of a number of different stand configurations.

FIGS. 4-7 illustrate a work light 10*b* according to yet another embodiment of the invention. Like components and features from the work light 10 shown in FIGS. 1 and 2 are labeled with like reference numerals with the letter "b." The work light 10*b* is substantially similar to the work lights 10, 10*a* of FIGS. 1-3; however, the work light 10*b* includes a separate actuator 86*b* coupled to the cap portion 26*b* of the housing 14*b*. In other words, the cap portion 26*b* is fixedly coupled to the first end 38*b* of the translucent portion 30*b* with fasteners 132. In the illustrated embodiment of the work light 10*b*, the separate actuator 86*b* is configured as a cylindrical knob 134 rotatably supported upon a top surface 138 of the cap portion 26*b*. In a similar manner in the work lights 10, 10*a* of FIGS. 1-3, the knob 134 is rotatably coupled to the light sources 50*b* via a transmission or other gear arrangement (not shown). The knob 134 is rotatable between four positions P-1, P-2, P-3, and P-4 (FIG. 8) based upon the emitted lighting pattern desired by the user.

Figure 6:
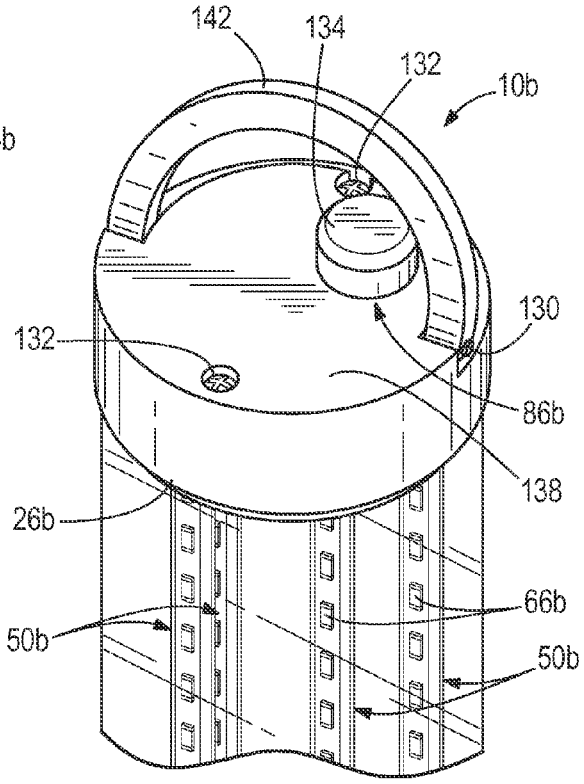
FIG. 6 is a top perspective view of the work light of FIG. 4.
Figure 7:
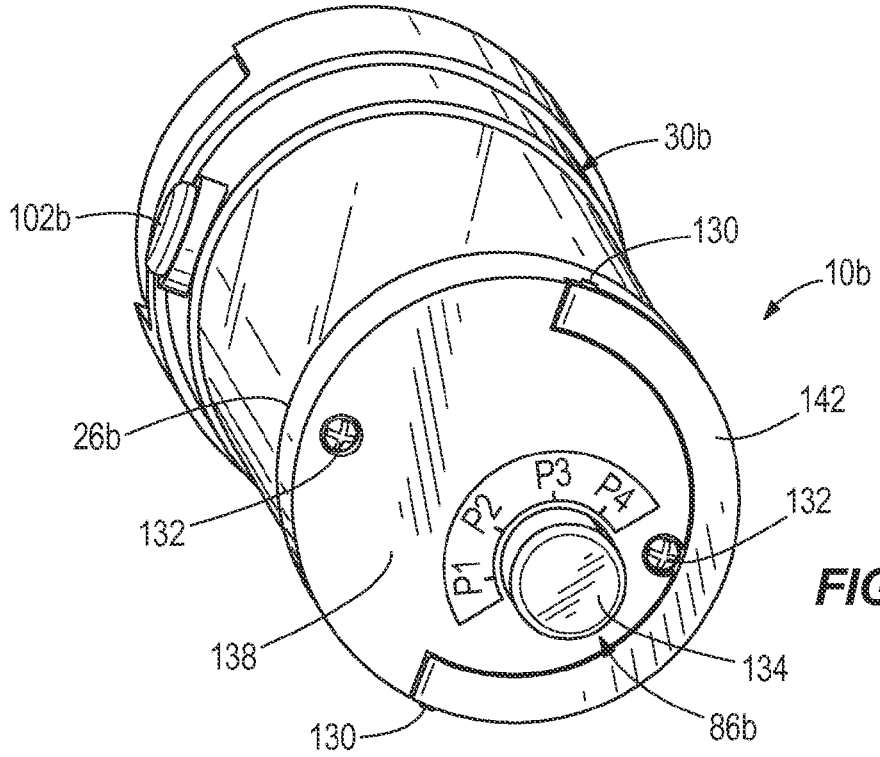
FIG. 7 is another top perspective view of the work light of FIG. 4.

With reference to FIG. 6, the work light 10*b* also includes a semi-circular handle 142 to facilitate transport, storage, or usage of the work light 10*b*. In the illustrated embodiment of the work light 10*b*, the handle 142 is coupled to the cap portion 26*b* by fasteners 130 and is pivotable between a retracted position (FIGS. 5 and 7) when the handle 142 is not needed and an extended position (FIG. 6) when the handle 142 is needed. Either of the work lights 10, 10*a* of FIGS. 1-3 may include a similar handle 142.

In operation of the work light 10*b* of FIGS. 4-7, the light sources 50*b* are rotatable between four positions P-1, P-2, P-3, and P-4 (FIG. 8) by rotating the knob 134 based upon the emitted lighting pattern desired by the user. In position P-1, all of the light sources 50*b* are oriented in the same direction with respect to a plane 126 containing the central axis 18*b* such that the light emitted by the light sources 50*b* is focused in a single (i.e., forward) direction. Consequently, the light sources 50*b* when oriented in the position P-1 collectively emit light throughout an angle of about 100 degrees surrounding the outer periphery 34*b* of the housing 14*b*.

In the position P-2, the two light sources 50*b* closest to the plane 126 are rotated outwardly at an angle of about 15 degrees with respect to the plane 126, while the two light sources 50*b* farthest from the plane 126 are rotated outwardly at an angle of about 45 degrees with respect to the plane 126. Consequently, the light sources 50*b* when oriented in the position P-2 collectively emit light throughout an angle of about 190 degrees surrounding the outer periphery 34*b* of the housing 14*b*.

In the position P-3, the two light sources 50*b* closest to the plane 126 are rotated outwardly at an angle of about 30 degrees with respect to the plane 126, while the two light sources 50*b* farthest from the plane 126 are rotated outwardly at an angle of about 90 degrees with respect to the plane 126. Consequently, the light sources 50*b* when oriented in the position P-3 collectively emit light throughout an angle of about 270 degrees surrounding the outer periphery 34*b* of the housing 14*b*.

In the position P-4, the two light sources 50*b* closest to the plane 126 are rotated outwardly at an angle of about 45 degrees with respect to the plane 126, while the two light sources 50*b* farthest from the plane 126 are rotated outwardly at an angle of about 135 degrees with respect to the plane 126. Consequently, with each light source 50*b* being capable of emitting light that spans an angle of about 100 degrees, the light sources 50*b* when oriented in the position P-4 collectively emit light surrounding the entire outer periphery 34*b* of the housing 14*b* (i.e., 360 degrees).

Figure 8:
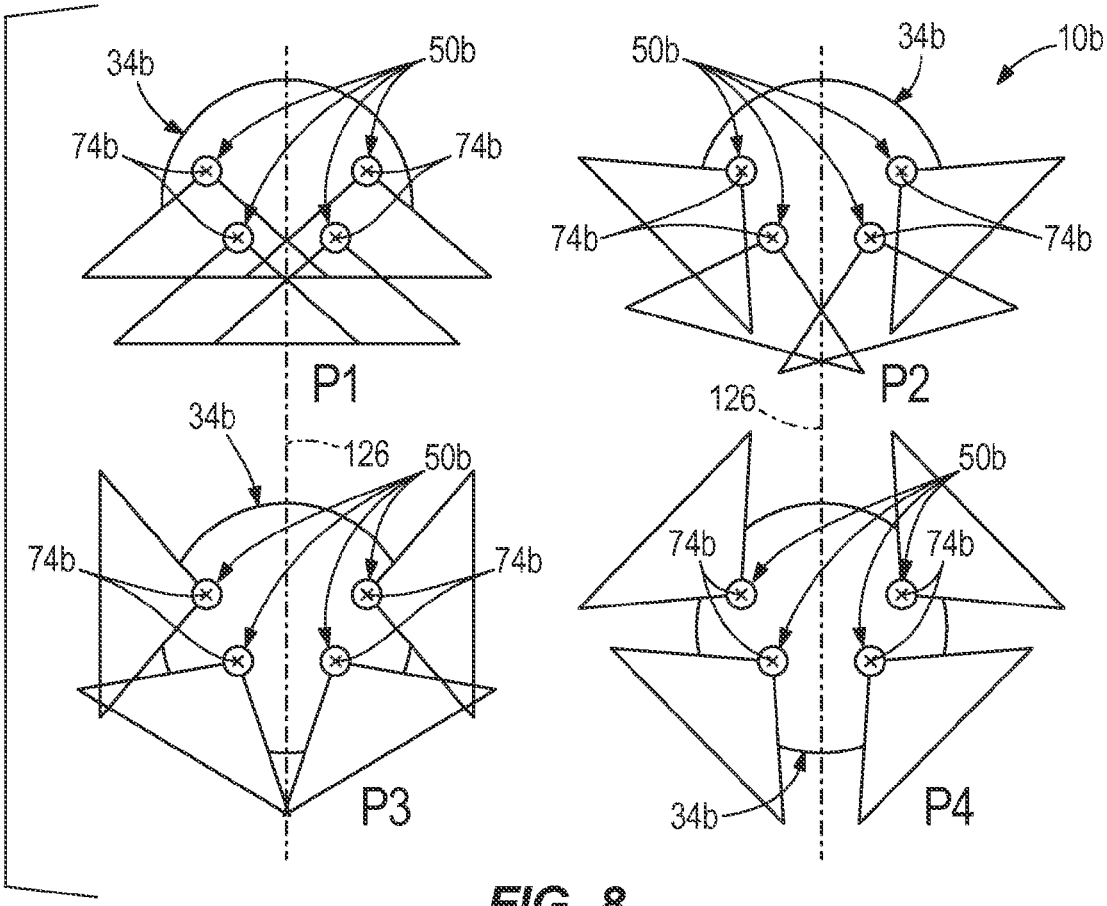
FIG. 8 is a schematic of a plurality of illumination positions P-1 through P-4 that may be assumed by the individual light sources within the work light of FIG. 4.

It should be understood that the work lights 10, 10*a* of FIGS. 1-3 operate in a similar manner, but for variations in the rotational angle of each of the light sources 50 due to the triangular arrangement of the light sources 50 compared to the trapezoidal arrangement of the light sources 50*b* shown in FIG. 8.

Various features of the invention are set forth in the following claims.

What is claimed is:

1. A work light comprising:

a housing;

a plurality of light sources positioned around a central axis of the housing, each of the light sources being movable relative to the housing to vary a lighting pattern emitted by the light sources relative to an outer periphery of the housing; and a single actuator coupled to the light sources for moving the light sources relative to the housing, wherein each of the light sources includes an elongated LED strip, and wherein each of the light sources is rotatable about an axis that is substantially parallel with the central axis of the housing.

2. The work light of claim 1, wherein the housing includes a translucent portion in which the light sources are positioned.

3. The work light of claim 1, wherein the plurality of light sources are movable between a first orientation, in which the plurality of light sources collectively emit light surrounding the entire periphery of the housing, and a second orientation, in which the plurality of light sources collectively emit light surrounding less than the entire periphery of the housing.

4. The work light of claim 1, further comprising a power tool battery pack for providing electrical energy to the light sources.

5. The work light of claim 1, further comprising a switch selectively electrically connecting the battery pack and the light sources.

6. The work light of claim 1, further comprising a fastener to clamp the housing to a stand.

7. The work light of claim 1, further comprising a handle coupled to the housing and pivotable between a retracted position and an extended position.

8. The work light of claim 1, further comprising a transmission interconnecting the actuator and at least one of the light sources.

9. The work light of claim 1, wherein each of the light sources is rotatable in response to rotation of the actuator.

* * * * *